US005150488A

United States Patent [19]

Yuan et al.

[11] Patent Number: 5,150,488

[45] Date of Patent: Sep. 29, 1992

[54] MULTIFUNCTIONAL TOOL

[75] Inventors: Gu F. Yuan; Kou M. Yuen; Zhao Q. Wei; Gu Z. Ying, all of Kowloon, Hong Kong

[73] Assignee: Neng-Shi (Hong Kong) Industrial Co., Tokwawan, Hong Kong

[21] Appl. No.: 708,678

[22] Filed: May 31, 1991

[30] Foreign Application Priority Data

Jun. 9, 1990 [CN] China ..... 90207321

[51] Int. Cl.[5] ..... B25B 7/22

[52] U.S. Cl. ..... 7/137; 81/389; 81/396

[58] Field of Search ..... 7/137; 81/389, 395-396

[56] References Cited

U.S. PATENT DOCUMENTS

| | | | |
|---|---|---|---|
| 1,266,567 | 5/1918 | Edwards | 81/396 X |
| 1,364,829 | 1/1921 | Berg | 7/137 X |
| 1,677,365 | 7/1928 | Peck | 81/389 X |
| 1,879,402 | 9/1932 | Monahan | 7/137 X |
| 3,768,346 | 10/1973 | Burthardt . | |
| 4,094,215 | 6/1978 | Hudson . | |
| 4,147,077 | 4/1979 | Tasato . | |
| 4,614,001 | 9/1986 | Liou . | |
| 4,890,520 | 1/1990 | Vassiliou . | |

FOREIGN PATENT DOCUMENTS 1567533 5/1980 United Kingdom .

*Primary Examiner*—James G. Smith
*Attorney, Agent, or Firm*—Collard & Roe

[57] ABSTRACT

A hand tool having a first handle with a front end and a blade end including a hollow frame and a sliding jaw both mounted on the front end thereof. The handle also has a core pin and a regulating screw rotatably mounted on the core pin, both located within the hollow frame. A second handle has a front end and a fixed jaw located at the front end thereof. A pivotal joint pin pivotally connects the first and second handles together with said jaws generally facing each other so that the handles are movable between an open and closed position, and the hand tool is usable as pliers. Locking means lock the handles in the closed position, so that the hollow frame is usable as a hammer head. Also, in the locked position, the sliding jaw is operatively connected to the regulating screw so that rotation of the regulating screw moves the sliding jaw with respect to the fixed jaw, whereby the hand tool is usable as a monkey wrench in the closed position.

3 Claims, 4 Drawing Sheets

MULTIFUNCTIONAL TOOL

BACKGROUND OF THE INVENTION

The present invention relates to a multifunctional hand tool and more particularly to a hand tool incorporating the functions of a pair of pliers, a carpenter s hammer and a monkey wrench, being applicable widely in production and operating repairs.

The traditional pliers, carpenter's hammer and monkey wrench are manufactured individually, each of which has its own function. And it is not convenient to make use of them and take along a full set tools for the multiplicity of manual operation.

BRIEF DESCRIPTION OF THE DRAWINGS

In view of the foregoing, it is the main object of the invention to provide a multifunctional hand tool incorporating the functions of a pair of pliers, a carpenter's hammer and a monkey wrench, being applicable for easy taking along and conveniently use in a multiplicity of manual operations.

Other and further objects, features and advantages of the invention will appear more fully from the following description taken in connection with accompanying drawings wherein.

DESCRIPTION OF THE INVENTION

Figure 1:
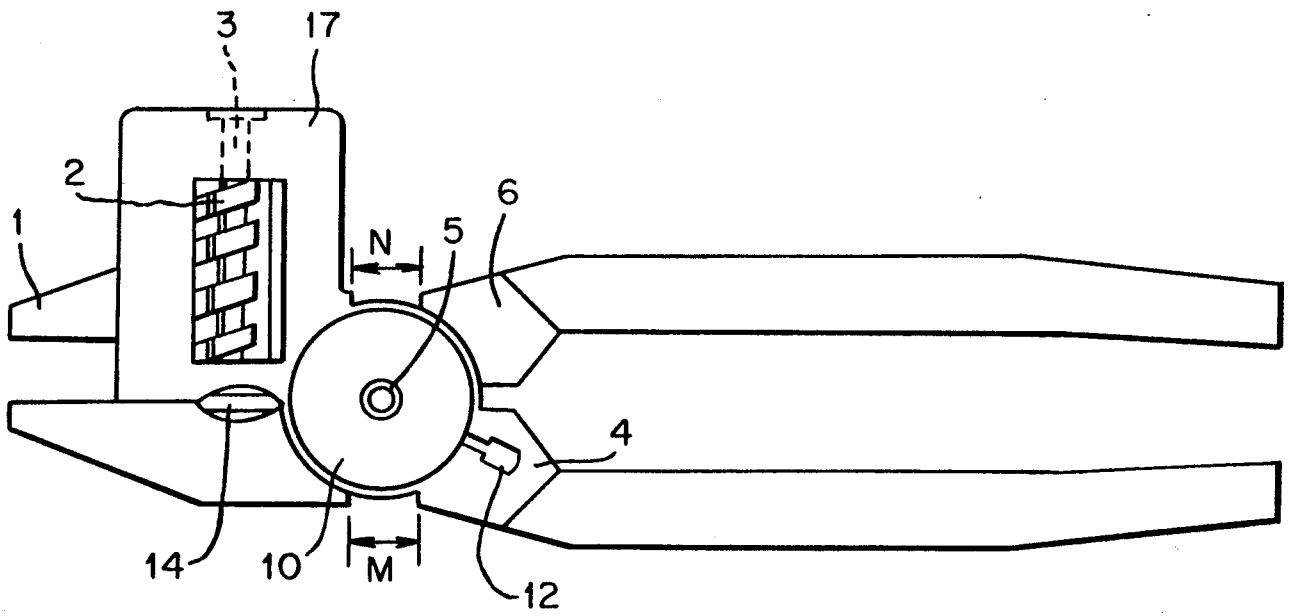
FIG. 1 is a top plan view of a preferred embodiment of this invention.
Figure 2:
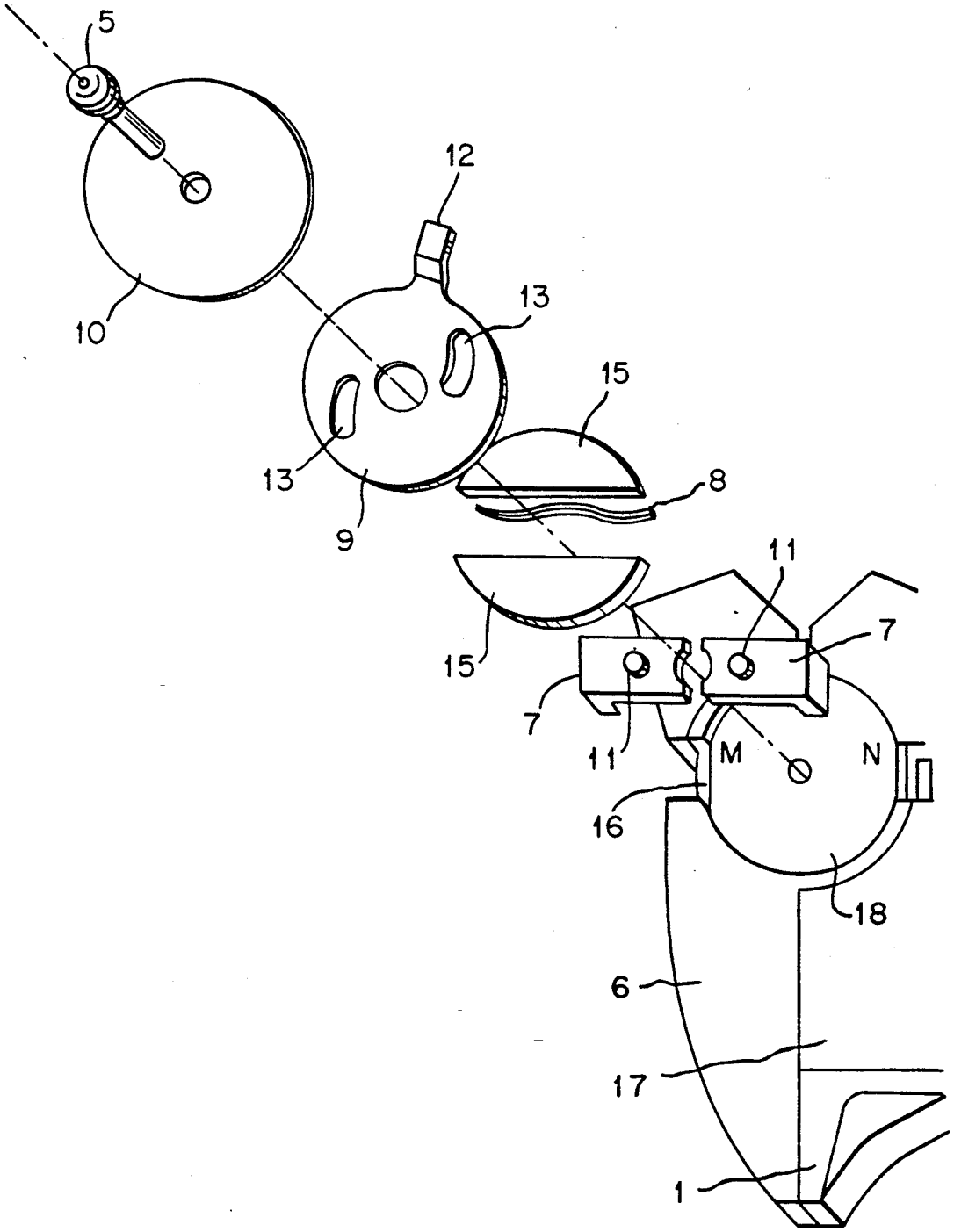
FIG. 2 is an exploded view in perspective of the preferred embodiment of the locking mechanism provided by this invention.

Referring to the drawings, wherein like reference characters designate like or corresponding parts throughout, as shown in FIGS. 1 and 2, the arrangement embodying the present invention comprises an adjustable jaw 1, a regulating screw 2, a core pin 3, a first piece of the pliers body 4 having a frame mount 17 at the front portion thereof, a pivotal joint pin 5, a second piece of the pliers body 6 having a fixed jaw at its front portion, a pair of sliding latch 7, a spring means 8, a shifter plate 9, and a cover plate 10. The adjustable jaw 1, regulating screw 2, core pin 3 and first piece of the pliers body 4 are connected together in the same way as in a monkey wrench, for instance, the adjustable jaw 1 comprises a groove and tongue for engaging with the corresponding slot space at the front portion of the frame mount 17 on the first piece of the plier body 4, the core pin 3 is fixed passing through the regulating screw 2 at the centre portion of the frame mount 17, and thereby the regulating screw 2 engages with the adjustable jaw 1 by means of a rack at the lower portion of the groove and tongue on the adjustable jaw 1 such that the adjustable jaw 1 can be moved up and down along the slot space by turning the regulating screw 2 clockwise or counter clockwise. Thus, the function of a monkey wrench can be reached by the invention. This structure of a monkey wrench may be effected by means of any existing technique in respect of the monkey wrench as well. The top end of the frame mount 17 on the first piece of the plier body 4 can be used as a carpenter's or fitter's hammer to achieve the second function of the present invention.

It should be noted that there is a key point in the arrangement, that is, to reach the function of the monkey wrench or the hammer, there must be provided a lock means for securing the two pieces of the pliers body together while the tool of the present, invention is being used as a monkey wrench or a fitter's hammer. In the arrangement embodying the present invention, the second piece of the pliers body 6 is pivotally connected with the first piece, of the pliers body 4 by a pivotal joint pin 5 and a locking mechanism thereby For instance, when the two pieces of the pliers body (4, 6) are put in position together, there are two cut-out portions M and N with the same shape disposed symmetrically by both sides of the pivotal joint pin 5, as shown in FIGS. 1 and 2. There is formed a circular platform 16 around the pivotal joint pin 5 at the joint portion of both pieces of the pliers body (4, 6), such that when the two pieces of the pliers body (4, 6) are pivotally jointed together there shall be formed a recess space 18 in the joint portion with the circular platform 16 as the base thereof and the two cut-out portions M, N symmetrically at both sides of the space 18. A column 11 is formed at upper surface of the two sliding latches 7 and the two sliding latches 7 are positioned at two sides of the pivotal joint pin 5 in the recess space 18 with their axes aligned. One end of the sliding latch 7 is aligned with the cut-out portion M or N, while the other end is biased by a spring means 8. Two half-moon platforms 15 are placed by both sides of the sliding latches 7 for guiding the sliding movement thereof A shifter plate 9, having a handle 12 attached to the side thereof, is positioned at the upper surface of the sliding latches 7, the spring means 8 and the half-moon platforms 15. There are two guiding slots 13 formed symmetrically about the pivotal joint pin 5 at the central portion of the shifter plate 9, which are parallel and taking the same shape with one another, engaging with the corresponding columns 11 at the sliding latches 7. A cover plate 10 is positioned at the outer side of the shifter plate 9 to cover the whole locking mechanism inside the recess space 18 of the pliers body. The cover plate 10 is secured by the pivoted joint pin 5 set through from the cover plate 10 to the back of the platform 16 of the pliers body.

In operation, the two pieces of pliers body (4, 6) shall be free from one another when the shifter plate 9 is turned with the guiding slots 13 thereof pulling back the columns 11 with the sliding latches 7 such that the sliding latches 7 disengage from the recesses M and N, namely, the sliding latches 7 are located inside the outer periphery of the inner circular platform 16. The two pieces of pliers body shall be locked up with one another when the shifter plate 9 is turned with the guiding slots 13 thereof pushing out the columns 11 with the sliding latches 7 such that the sliding latches 7 engage with the recesses M and N. Owing to the accuracy to the dimension and under the action of the spring means 8, the shifter plate 9 shall not be self-moving after having been turned by pulling or pushing the handle 12.

Figure 3B:
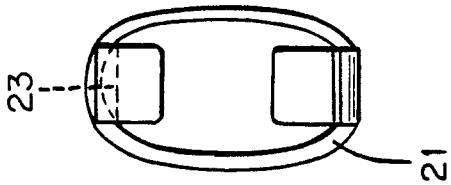
FIG. 3*b* is a right side elevational view of FIG. 3*a*.
Figure 3A:
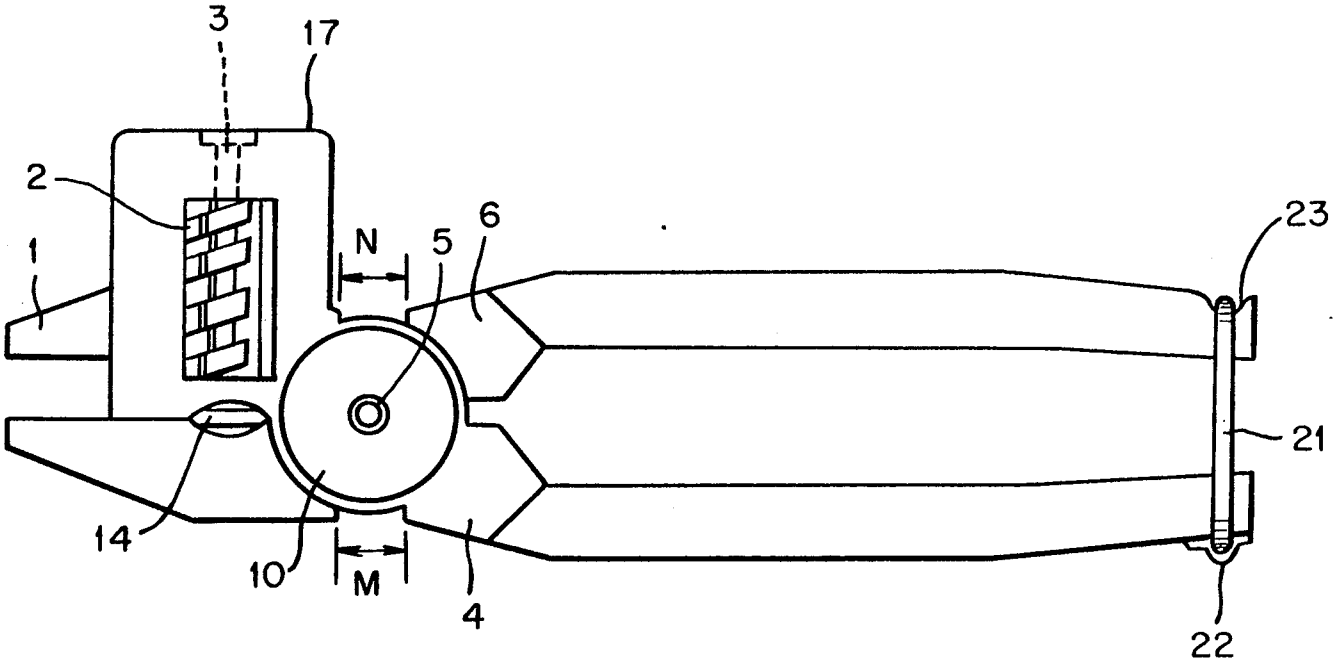
FIG. 3*a* is a top plan view of an alternate embodiment of the invention.

In another embodiment of the present invention, as shown in FIGS. 3*a* and 3*b* locking the mechanism comprises a elongated hoop 21, with one end thereof being hinged by a mount 22 fixed on the end portion of one piece of said pliers body, and the other end thereof being snapped over a slot 23 formed on the end portion of the other piece of said pliers body at will.

Figure 4A:
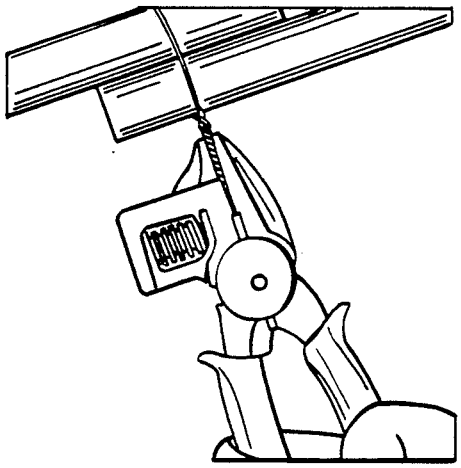
FIGS. 4*a* and 4*b* show the invention used as a pair of pliers.
Figure 4B:
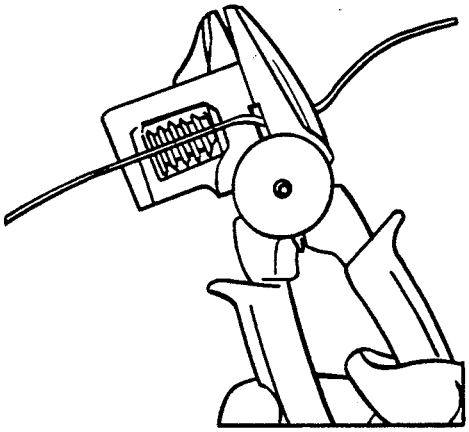
Figure 5:
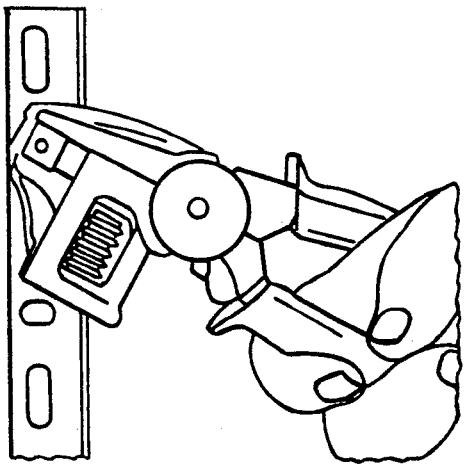
FIG. 5 shows this invention used as a monkey wrench.
Figure 6:
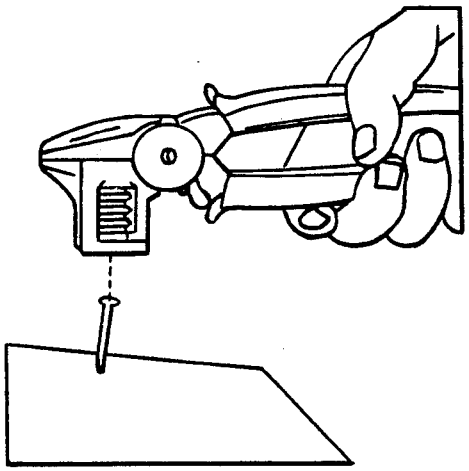
FIG. 6 shows this invention used as a carpenter's hammer.

Thus, according to this invention it can be ensured that the operation of the tool with the locking mechanism is effected When the locking mechanism is in release position, the two pieces of pliers body (4, 6) shall be free from one another to effect the function of a pair of pliers, such as to twist or cut 14 a wire (FIGS. 4*a* and 4*b* when the locking mechanism is in locking position, the tool shall be used as a monkey wrench (FIG. 5) or a carpenter's hammer (FIG. 6).

The multifunctional tool or variotool provided by the present invention is able to optionally effect the functions of a pair of pliers, or a monkey wrench and a hammer, for instance, to cut off or twist up a wire, to turn a screw or a nut tight or loose, and to hammer something, etc. The multifunctional tool or variotool provided by the present invention may be made of any suitable metallic materials such as tool steel ,spring steel, and the like.

In comparison with the individually manufactured tools, such as a pair of pliers, a monkey wrench and a carpenter's hammer, the multifunctional tool or variotool provided by the present invention has the advantages in the indiscrete structure, the multifunction in one piece, the convenience to carry, the flexibility of use, the value of practical use, the efficiency and the material saving so that it is useful for industry and domicile.

While the invention has been particularly shown and described with reference to preferred embodiments thereof, it will be understood by those skilled in the art that the foregoing and other changes in form and details can be made therein without departing from the spirit and scope of the invention which is to be defined by the following claims.

What is claimed is:

1. A multifunctional hand tool comprising:

a first handle with a front end and a back end including a hollow frame and a sliding jaw both mounted on the front end thereof;

a core pin and a regulating screw rotatably mounted on said core pin both located within said hollow frame;

a second handle with a front end and an back end, having a fixed jaw located at the front end thereof;

a pivotal joint pin for pivotally connecting said first and second handles together, with said jaws generally facing each other so that said handles are movable between an open and closed position and the hand tool is usable as pliers; and locking means for locking said handles in the closed position so that said hollow frame is usable as a hammer head, and wherein said sliding jaw is operatively connected to said regulating screw so that rotation of said regulating screw moves said sliding jaw with respect to said fixed jaw whereby the hand tool is useable as a monkey wrench in the closed position.

2. A multifunctional hand tool according to claim 1, additionally comprising:

a circular platform having front and back sides, with a lip at the periphery of said platform on the front side forming a round recess disposed adjacent to the front side of said platform, and two channels within the lip located symmetrically on either side of the recess, said joint pin extending through the center of said circular platform;

said locking means including a pair of sliding latches disposed in the recess on opposite sides of said joint pin and aligned with said channels, said latches each having a cylindrical pin with an axis which are parallel to the axis of said joint pin, said pins extending away from the front surface of said platform, said locking means further including spring mean sin contact with said latches for frictionally retaining said latches;

a shifter plate with a handle at one side thereof, rotatably mounted on said joint pin, said shifter plate including two guiding slots disposed symmetrically on either side of said joint pin for receiving said pins a cover plate placed over said shifter plate so that said joint pin passes respectively through said cover plate, said shifter plate, said locking means and said circular platform to the back side thereof; and wherein said shifter plate is rotatable from an unlocked position to a locked position, wherein said pins slide within said guiding slots, sliding said latches outwardly from the recess through the channels to a position between portions of said handles to prevent them from moving together thereby locking said handles in the closed position.

3. A multifunctional hand tool according to claim 1, wherein said locking means includes hinge means and an elongated hoop for engaging the back ends of said handles to lock said handles in the closed position, said hinge means flexibly connecting said hoop to the back end of one of said handles, the other of said handles having a slot at its back end for removable engagement with said hoop.

* * * * *